US007143460B1

(12) United States Patent
Kato

(10) Patent No.: US 7,143,460 B1
(45) Date of Patent: Dec. 5, 2006

(54) PORTABLE ROTARY BRUSH CLEANING DEVICE

(76) Inventor: Barbara Kato, 1420 N. Maassasoit, Chicago, IL (US) 60651

( * ) Notice: Subject to any disclaimer, the term of this patent is extended or adjusted under 35 U.S.C. 154(b) by 370 days.

(21) Appl. No.: 10/304,036

(22) Filed: Nov. 25, 2002

(51) Int. Cl.
*A46B 13/00* (2006.01)
*A46B 13/04* (2006.01)
*A47L 11/00* (2006.01)

(52) U.S. Cl. ..... 15/29

(58) Field of Classification Search ..... 15/29, 15/24, 1.7, 97.1; 401/291
See application file for complete search history.

(56) References Cited

U.S. PATENT DOCUMENTS 2,608,439 A * 8/1952 Bates et al. ..... 137/206
2,744,271 A * 5/1956 Florence ..... 15/29
4,071,919 A * 2/1978 Fields et al. ..... 15/21.1
6,523,209 B1 * 2/2003 Dickerson ..... 15/97.1
6,795,994 B1 * 9/2004 Nahoom ..... 15/29

FOREIGN PATENT DOCUMENTS

GB 2164246 * 3/1986

* cited by examiner

*Primary Examiner*—Gladys JP Corcoran
*Assistant Examiner*—Laura C Guidotti
(74) *Attorney, Agent, or Firm*—Goldstein Law Offices PC.

(57) ABSTRACT

A portable rotary brush cleaning device for cleaning the inside of a bathtub or other household surfaces, comprising a machine body, a brush handle having two ends, and a motor-driven brush. The brush handle is attached to the machine body at one of its ends and to the brush at its other end. The machine body houses a water tank, a cleaning solution tank, a water pump, and a cleaning solution pump. The pumps supply water and cleaning solution to the brush via hoses that run along the length of the brush handle. A user first wets the brush by activating buttons which control the pumps. The user then activates the motor which causes the brush to rotate upon the brush handle. The user alternates between wetting the brush and rotating the brush on the surface to be cleaned, until the surface has been sufficiently cleaned.

1 Claim, 6 Drawing Sheets

44T 30
24
ON/OFF
26A
26B
SOLUTION
WATER
26C
ROTATION
54
BRUSH
52
HOSE
48
HOSE
38
22S
50B
50C

PORTABLE ROTARY BRUSH CLEANING DEVICE

BACKGROUND OF THE INVENTION

1. Field of the Invention

The invention relates to a portable rotary brush cleaning device which may be used to clean the inside of a bathtub, or floors, or other household surfaces. The device has a machine body, a brush handle which is attachable to the machine body, and a variety of brushes which are selectively attachable to the brush handle. The machine body houses tanks which separately contain cleaning solution and water, pumps for pumping these liquids to the brushes, and hoses which connect the tanks to the pumps. These hoses ultimately lead to the brush and wet the brush bristles, thereby increasing the efficiency of cleaning. A motor in the brush handle selectively rotates the brush.

2. Description of the Related Art

A variety of surfaces located in the home require periodic cleaning by a homeowner. Some of these surfaces are relatively inaccessible and may only be reached by bending and consequently, a homeowner may hurt his/her back while attempting to reach these surfaces.

Various devices have been created which may be used to clean different surfaces. U.S. Pat. No. 4,825,496 to Taylor appears to show a cleaning device comprised of a wheeled trolley with a motor driven pump to supply fluid to a rotary brush. U.S. Pat. No. 4,084,281 to Smith appears to show a turbine driven fluid powered rotary brush cleaner. U.S. Pat. No. 3,958,298 to Canaan appears to show a cleaning nozzle for a vacuum with means to feed a liquid detergent. U.S. Pat. No. 5,504,969 to Beryozkin appears to show a device for washing and cleaning a vehicle and is provided for general interest in the art.

While these units may be suitable for the particular purpose employed, or for general use, they would not be as suitable for the purposes of the present invention as disclosed hereafter.

SUMMARY OF THE INVENTION

It is an object of the invention to provide a cleaning device which has a brush which is capable of rotating intermittently, according to the needs of the user. Accordingly, this device has a brush which is attachable to a brush motor which is located in the brush handle, and thereby provides the user with a choice of brush speeds to be used for different surfaces.

It is a further object of the invention to provide a cleaning device which may be easily moved between various locations within the home. Accordingly, the device is equipped with two side wheels on its bottom surface, so that it may be rolled between locations without the necessity of lifting the device.

It is another object of the invention to provide a cleaning device which is relatively inexpensive and whose cost is not prohibitive. Accordingly, the functional components of this device, including a motor which rotates the brush and pumps which furnish the brush with water and cleaning solution, are not complex and do not make the cost of this device unduly expensive.

It is yet another object of the invention to provide a cleaning device which is relatively lightweight and which can therefore be easily carried between different locations. Accordingly, this device is equipped with a handle on its upper surface, by which the device may be easily carried.

Furthermore, this device is comprised of components which are not unduly heavy, and the device may be easily carried by most homeowners. Additionally, the brush handle and the tanks which hold the cleaning solution may be removed from the body of the machine before attempting to lift the device. Moreover, the water tank may be drained. These features therefore contribute to enhanced portability of the device.

It is yet a further object of the invention to provide a cleaning device which may be outfitted with a variety of different brushes, depending on the type of surface which is to be cleaned. Accordingly, the brushes are removable from the brush handle head to allow selective attachment of a pad brush, a sponge brush, and a bristled brush.

It is yet a still further object of the invention to provide a cleaning device which has buttons and switches which provide a user with the capability of selectively wetting the brush with cleaning solution and with water. Accordingly, this device is equipped with switches on the machine housing and with buttons on the brush handle, which selectively power the pumps which pump liquids to the brush, and thereby furnish liquid to the brush.

The invention is a portable rotary brush cleaning device for cleaning the inside of a bathtub or other household surfaces, comprising a machine body, a brush handle having two ends, and a brush. The brush handle is attached to the machine body at one of its ends and to the brush at its other end. The end of the brush handle which is attached to the brush contains a motor which selectively rotates the brush. The machine body houses a water tank, a cleaning solution tank, a water pump, a cleaning solution pump, and hoses which connect the tanks to the pump and the pumps to the brush. The pumps supply water and cleaning solution to the brush via hoses that run along the length of the brush handle. The machine body has switches which enable the pumps and the motor. Similarly, the brush handle has buttons which allow the user to control the pumps and the motor. The user first turns on the pump buttons in order to wet the brush. The user then activates the motor, and thereby causes the brush to rotate. The user alternates between wetting the brush and rotating the brush on the surface to be cleaned, until the surface has been sufficiently cleaned.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
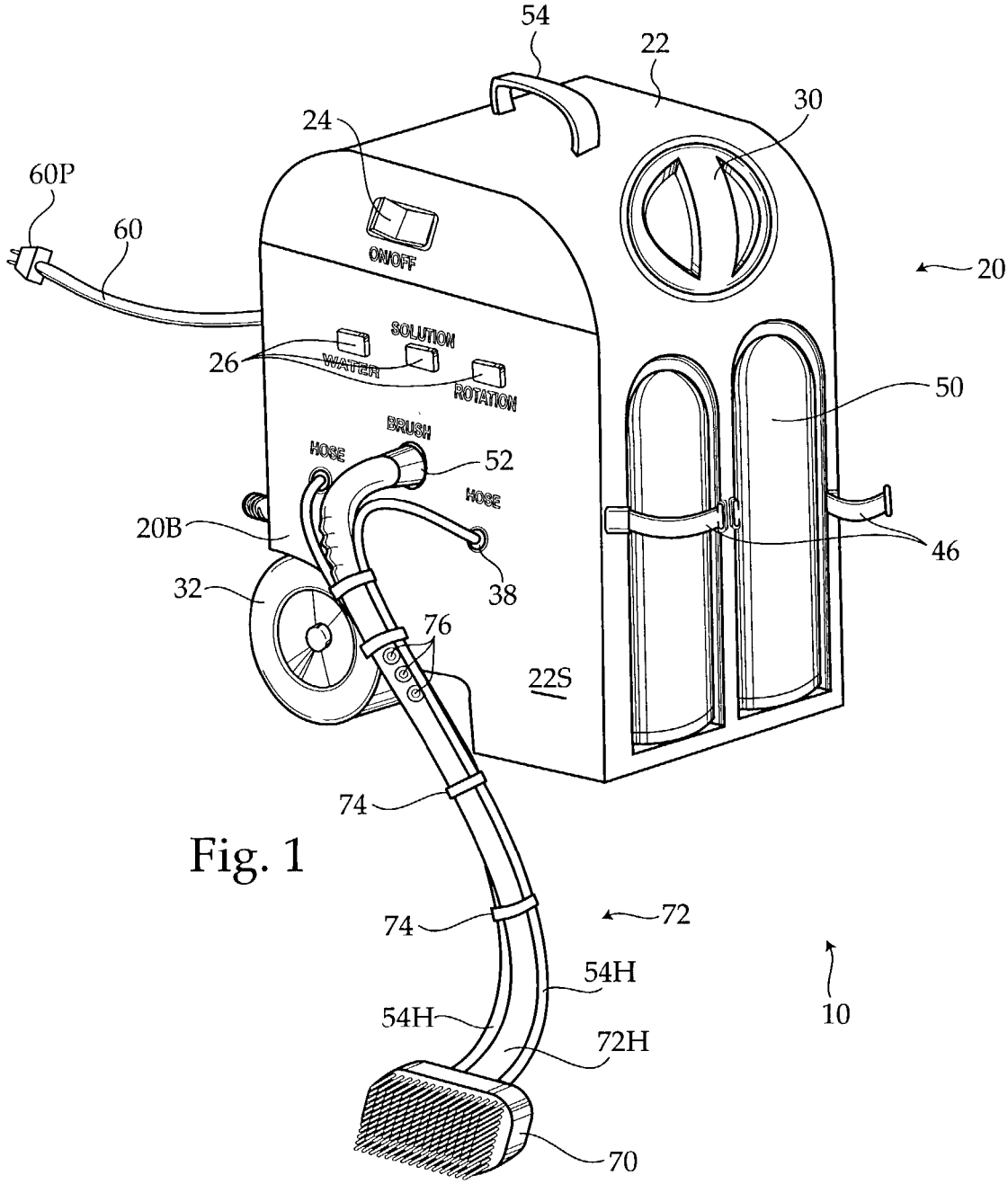
FIG. 1 is a perspective view of the body of the device and the associated brush handle.

FIG. 1 illustrates the portable rotary brush cleaning device 10, which is comprised of a machine body 20 having a bottom portion 20B, a machine housing 22, and two side wheels 32 located near the bottom portion 20B of the machine body 20. The cleaning device 10 further has a brush handle 72, a brush 70, and brush handle hoses 54H which extend along the brush handle 72 from the machine body 20 to the brush 70. Integral components of the machine body 20 are enclosed by the machine housing 22. The device has an electrical cord 60 having a plug 60P, and a water tank drain 48 which enter the machine body 20 through openings on the machine housing 22. A pair of cleaning solution tanks 50 are mounted external to the housing 22.

Figure 6:
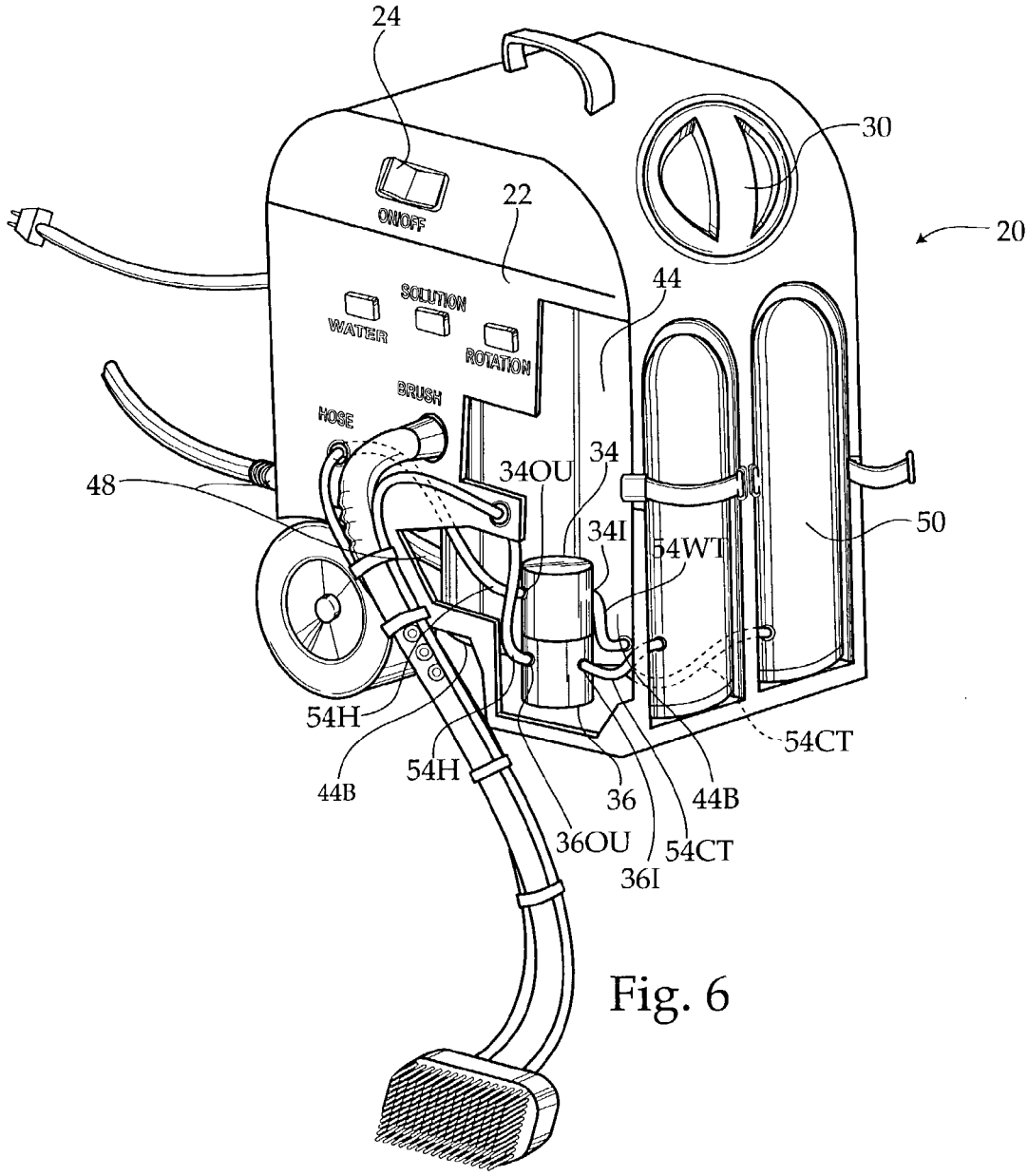
FIG. 6 is a perspective view of the body of the device and the associated brush handle, with a portion of the machine housing removed to show the locations and interconnections of the water pump, the solution pump, and the hoses which lead from the pumps to the brush.

Turning momentarily to FIG. 6, which is a perspective view of the device 10 with a portion of the machine housing 22 cut away in order that the components of the machine body 20 may be more easily seen, the machine body 20 is seen to comprise a water tank 44, a cleaning solution pump 36 and a water pump 34. The machine body 20 also contains a pair of cleaning solution tank hoses 54CT and a water tank hose 54WT. The cleaning solution pump 36 has an inlet valve 36I and an outlet valve 36OU. Similarly, the water pump 34 has an inlet valve 34I and an outlet valve 34OU. The water tank hose 54WT connects the water pump inlet valve 34I to the water tank 44. The cleaning solution tank hoses 54CT connect the cleaning solution pump inlet valves 36I to the cleaning solution tanks 50. The water pump outlet valve 34OU is connected to one of the two brush handle hoses 54H. Similarly, the cleaning solution pump outlet valve 36OU is connected to the other brush handle hose 54H.

Figures 2, 2A, 2B:
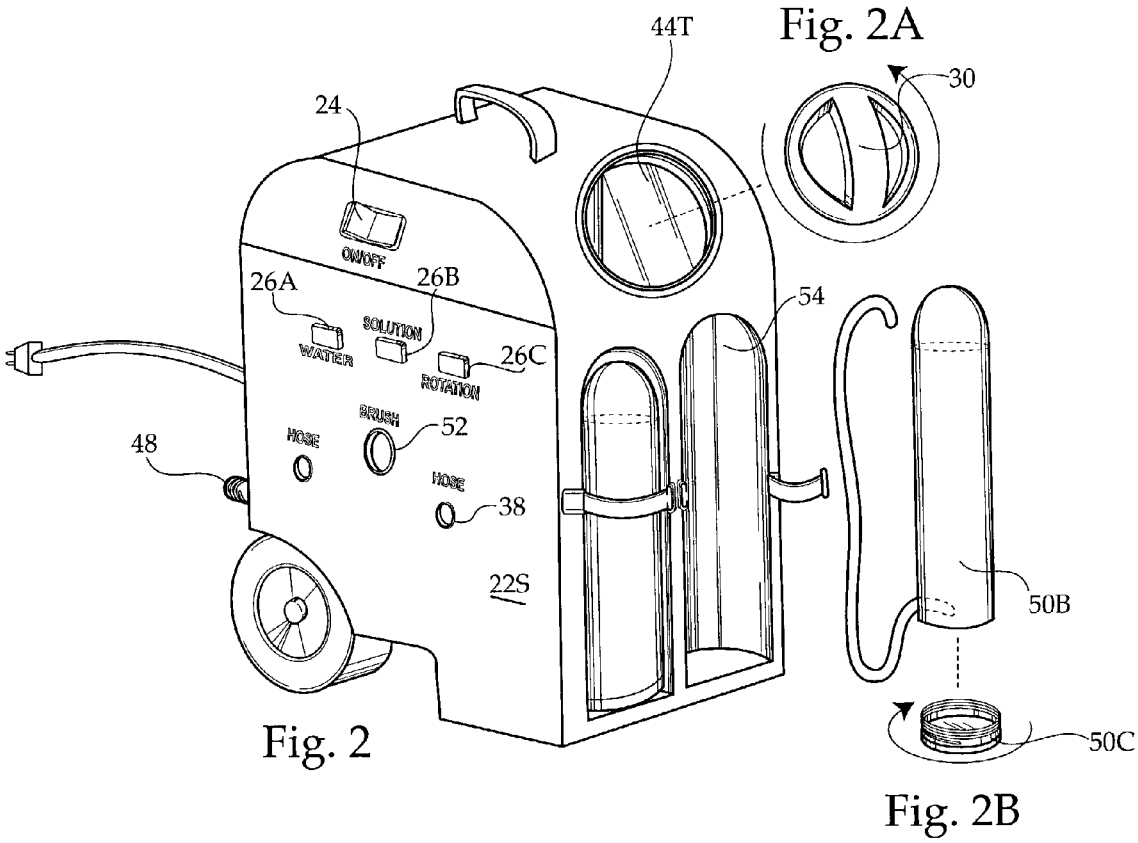
FIG. 2 is a perspective view of the device without the brush handle and the hoses. The water tank cap has been removed from the machine housing by rotation in the direction of the arrow. The cap for the solution tank bottom has been removed from the solution tank bottom by rotation in the direction of the arrow.

FIG. 2 is a perspective view of the machine body 20 after the brush handle 72 and the brush handle hoses 54H have been detached. The machine housing 22 has two hose outlets 38 and a brush handle socket 52. As seen, the machine body 20 contains two cleaning solution tank compartments 54, each of which may hold one of the cleaning solution tanks 50. One of the cleaning solution tanks 50 is shown detached to allow an unobstructed view of the cleaning solution tank compartment 54. The machine body 20 is also seen to comprise a water tank 44. The water tank 44 has a water tank top 44T and a water tank bottom 44B, defining a water tank interior therebetween. A fill cap 30 is selectively attached to the water tank top 44T. The cap 30 is removed as seen in FIG. 2 to allow the water tank 44 to be filled with water. The water tank drain 48 is attached to the water tank bottom 44B. The machine housing 22 has attached straps 46 for holding the cleaning solution tanks 50 securely within the cleaning solution tank compartments 54.

In FIG. 2, one of the cleaning solution tanks 50 has been removed from the cleaning solution tank compartment 54, in order to illustrate the components of the tank. The cleaning solution tank 50 has a tank top 50T and a tank bottom 50B, each of which may be removed from the cleaning solution tank 50 by rotation. FIG. 2B is a perspective view of the cap 50C for the cleaning solution tank bottom 50B after it has been removed from the cleaning solution tank bottom 50B by rotation along the line of the arrow.

FIG. 2A is a perspective view of the fill cap 30 which covers the water tank top 44T after it has been removed from the machine housing 22 by rotation along the lines of the arrow.

Figure 4:
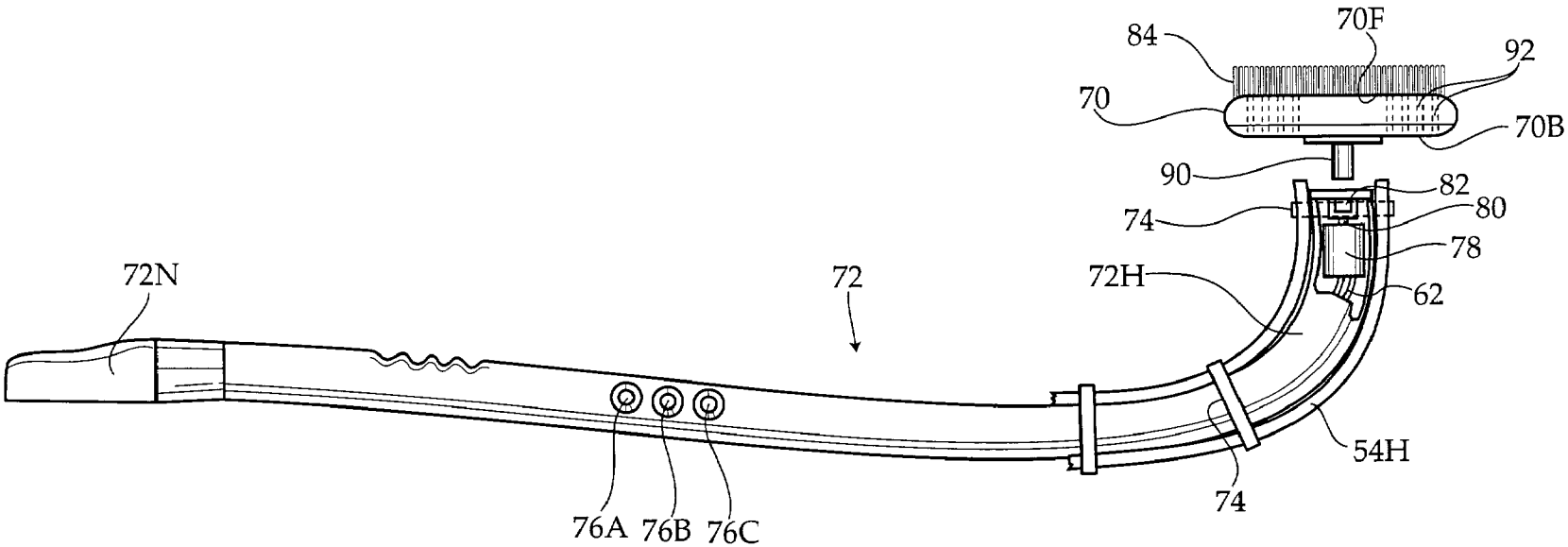
FIG. 4 is a side view of the brush handle and one of the brushes, with parts broken away at the brush handle head to illustrate internal details thereof.

Turning momentarily to FIG. 4, the brush handle 72 has two ends. The brush handle head 72H is located at one end of the brush handle 72 and a brush handle nozzle 72N is located at the other end. A brush motor 78 is located within the brush handle head 72H which causes the brush 70 to rotate. The brush handle head 72H has an electrical cord 62 within which supplies electricity to the motor 78. The brush handle head 72H also contains a shaft 80 which is attached to and is rotated by the motor 78, and also a socket 82 which is attached to the shaft 80. The brush 70 has a brush coupler 90 which attaches the brush 70 to the socket 82. Rotation of the shaft 80 by the motor 78 thereby causes the brush 70 to rotate. The other end of the brush handle 72 is the brush handle nozzle 72N which connects the brush handle 72 to the machine body 20. The two brush handle hoses 54H run fully along the brush handle 72. The brush handle hoses 54H supply water and cleaning solution to the brush 70 which is selectively attachable to the brush handle head 72H. The brush handle hoses 54H enter the machine body 20 through the machine housing 22. After entering the machine body 20, the brush handle hoses 54H connect to the water pump outlet valve 34OU and the cleaning solution pump outlet valve 36OU.

As seen in FIG. 4, the brush 70 has a brush front 70F and a brush back 70B. The brush 70 also has through channels 92 which connect the brush back 70B to the brush front 70F. These through channels 92 communicate liquids to the brush front 70F which are dispensed onto the brush back 70B after being pumped through the brush handle hoses 54H. The brush handle 72 also has handle buttons 76 located on its side.

FIG. 2 indicates that the machine housing 22 has an on-off switch 24 located on its surface 22S which selectively allows the device to be powered. The machine housing 22 also has housing switches 26 located on its surface 22S, including a housing water switch 26A, a housing solution switch 26B, and a housing rotation switch 26C which allow a user to selectively enable the water pump 34 and the cleaning solution pump 36, and also the motor 78 which is located in the brush handle head 72H, respectively. The handle buttons 76 include a handle water button 76A, a handle solution button 76B, and a handle rotation button 76C, which allow the user to selectively activate the water pump 34, the cleaning solution pump 36, and the motor 78, respectively, when the on/off switch 24 is previously turned "on" and the corresponding housing switches 26 on the machine housing 22 are previously enabled. The buttons 76A, 76B, and 76C may be two position switches. In particular, the handle water button 76A can control the water pump 34 to selectively allow a "sprinkle" of water to be released, or a more intense spray. Further, the motor 78 can be controlled by the handle rotation button 76C to allow gentle or faster, more intense scrubbing.

Turning again momentarily to FIG. 6, the entire path of the water and cleaning solution from the water pump 34 and the cleaning solution pump 36, respectively, to the brush 70 can be seen. The water tank hose 54WT which leads from the water tank 44 to the water pump 34, and the cleaning solution tank hoses 54CT, which lead from the cleaning solution tanks 50 to the cleaning solution pump 36, may be seen. Similarly, the two brush handle hoses 54H which lead from the pumps to the brush 70 are visible. The machine housing 22 has two hose outlets 38 extending through it. The two brush handle hoses 54H exit the machine body 20 through the hose outlets 38, before running longitudinally along the length of the brush handle 72. The brush handle 72 has a number of hose clamps 74 periodically situated along its length which securely attach the two brush handle hoses 54H to the brush handle 72. Water and cleaning solution are pumped through the brush handle hoses 54H. These liquids are released from the brush handle hoses 54H onto the brush back 70B. The through channels 92 communicate these liquids through the brush 70 and cause the brush front 70F to be wetted with a mixture of cleaning solution and water, thereby increasing the efficiency of cleaning by the device.

Figure 3:
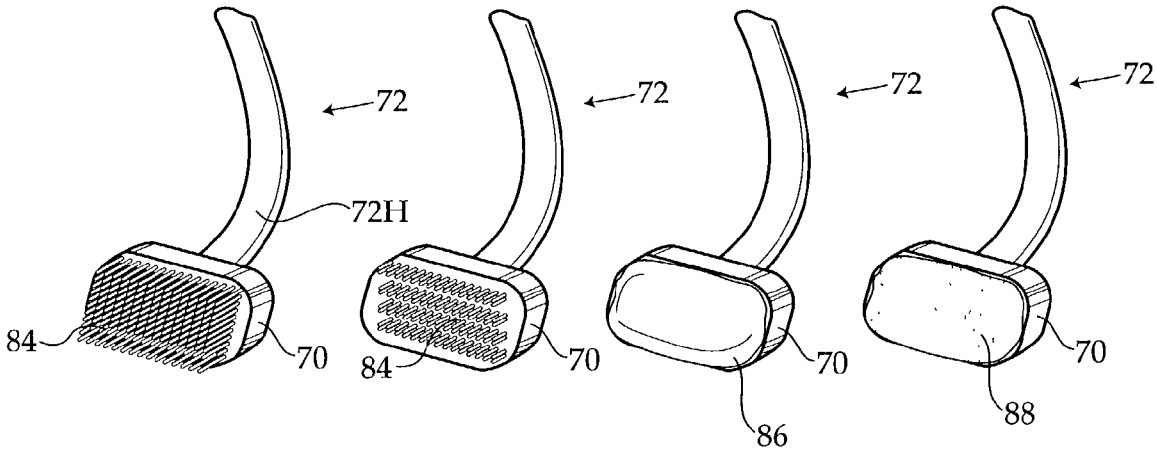
FIG. 3 is a perspective view of a variety of brushes which may be selectively attached to the brush handle head.

FIG. 3 is a perspective view of a variety of brushes 70 which may be selectively attached to the brush handle head 72H. Four different brushes 70 are shown. Two brushes 70 are illustrated which have bristles 84 located on the brush front 70F. These two brushes 70 each have different densities and different bristle qualities. Additionally, a brush 70 which has a sponge 86 located on the brush front 70F is illustrated. Finally, a brush 70 which has scouring material 88 located on the brush front 70F is illustrated.

Figure 5:
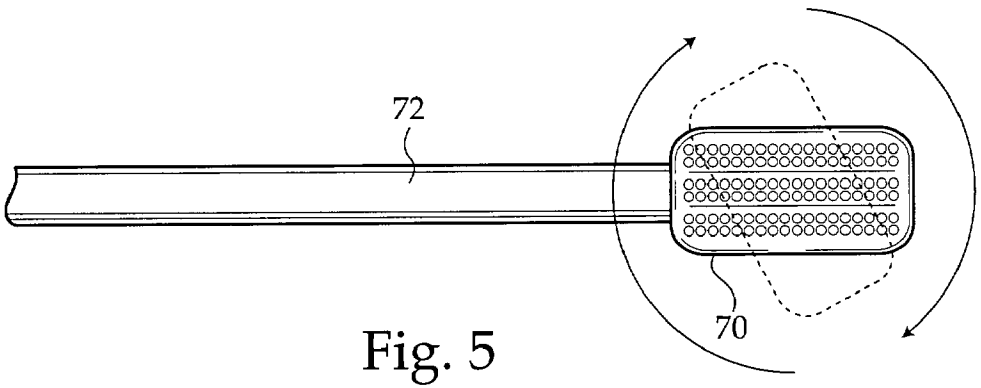
FIG. 5 is a bottom view of the brush handle after the brush has been attached. Arrows indicate the direction of motion of the brush with respect to the brush handle.

FIG. 5 is a bottom view of the brush handle 72 after the brush 70 has been attached. Arrows indicate the direction of motion of the brush 70 with respect to the brush handle 72 after the user has activated the motor 78 which is located within the brush handle head 72H.

Figure 7:
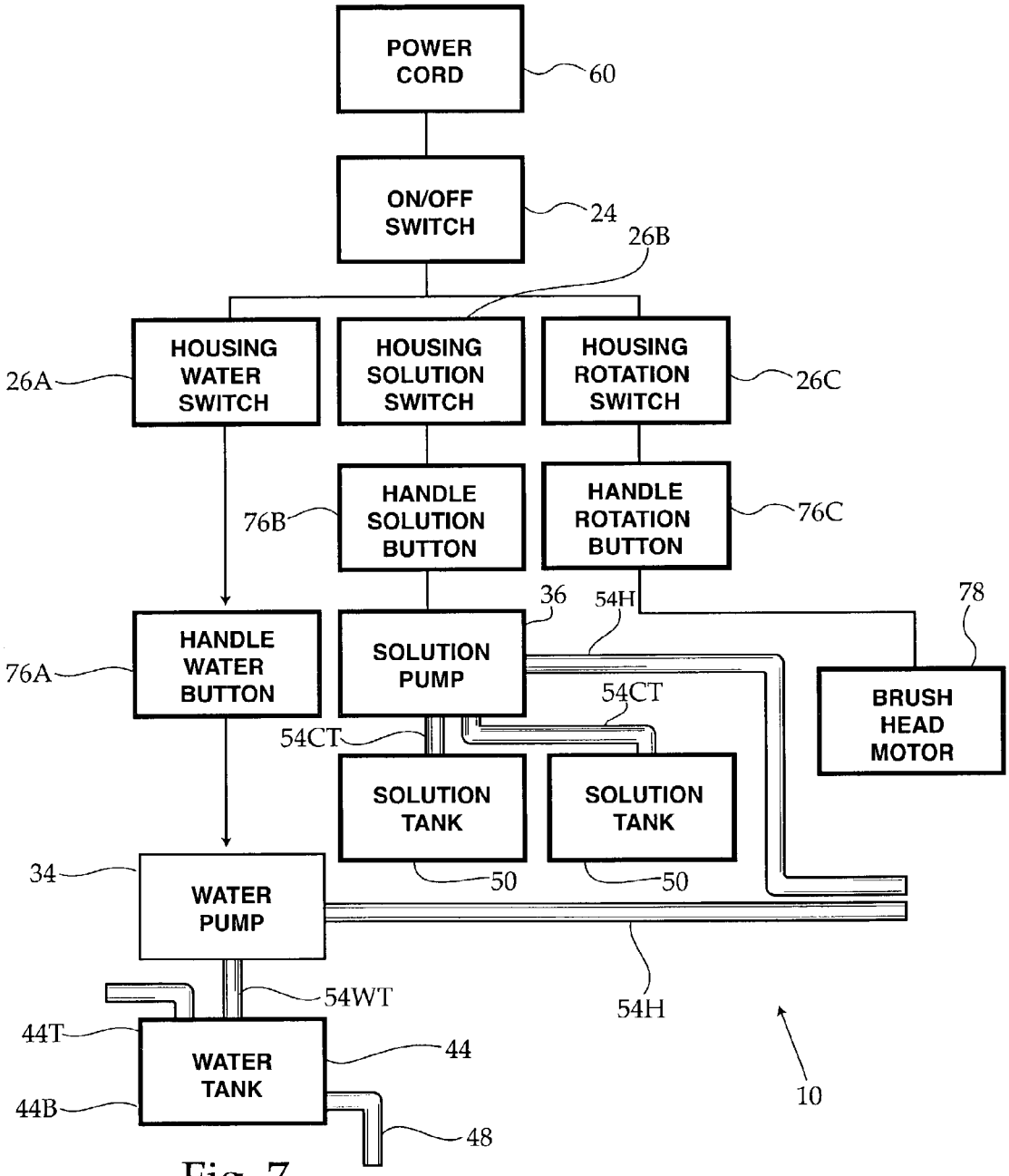
FIG. 7 is a block diagram which illustrates the interconnection between various components of the device.

FIG. 7 is a block diagram for the cleaning device 10. The power cord 60 leading into the machine body 20 supplies electricity to the device 10. There are three levels of control for the water pump 34, the cleaning solution pump 36, and the motor 78 located in the brush handle head 72H. In particular, before any of these components can be operated, the on/off switch 24 must be in the "on" position. Additionally, the appropriate housing switch 26A, 26B, or 26C must be enabled by the user, and then the appropriate brush handle button 76A, 76B, and 76C, must be pressed by the user. Thus, for example, for the water pump 34 to be turned "on", the on/off switch 24 must be in the "on" position, the housing switch 26 for the water pump 34 must be "on", and the brush handle button 76 for the water pump 34 must be pressed by the user so that it is in the "on" position. When the water pump 34 is turned on, water is pumped from the water tank 44 through the tank hose 54T, through the water pump 34, and through the brush handle hose 54H, and finally to the brush back 70B, where the through channels 92 extending from the brush back 70B to the brush front 70F are located.

In use, a user positions the device 10 on a flat surface adjacent to the area to be cleaned. The user determines which of the available brushes 70 to attach to the brush handle head 72H and attaches that brush 70 to the brush handle head 72H by pushing the brush coupler 90 into the socket 82 which is located in the brush handle head 72H. The user ensures that the cleaning solution tanks 50 are strapped securely into their compartments 54 and that they contain cleaning solution. The user fills the water tank 44 by removing the fill cap 30 which is located near the water tank top 44T, and then by pouring water into the water tank 44. Once the water tank 44 has been filled, the fill cap 30 is threaded back on the water tank top 44T. The electrical cord 60 leading into the machine body 20 is plugged into an outlet. The user then turns on the on/off switch 24 which is located on the machine housing 22. The user then wets the brush 70 with both cleaning solution and water by turning on the corresponding housing switches 26 and handle buttons 76. When the brush 70 has been sufficiently wetted, the user turns off the handle buttons 76 for the water pump 34 and the solution pump 36. The user then presses the handle button 76 which turns on the motor 78 which is located in the brush handle head 72H. The user thereby alternates between turning on the pumps which furnish liquid to the brush and turning on the motor 78 located in the brush handle head 72H. The motor 78 may only be turned "on" when the pumps are in the "off" position, and vice verse. After the surface has been sufficiently cleaned, the user turns "off" the on/off switch 24 which is located on the machine housing 22. The user then removes the plug 60P which is attached to the power cord 60 from the electrical outlet. If prolonged storage is contemplated, the user may drain the water tank 44 by opening the water tank drain 48. The device 10 may then be stored until it is again needed.

In conclusion, herein is presented a portable rotary brush cleaning device. The invention is illustrated by example in the drawing figures, and throughout the written description. It should be understood that numerous variations are possible, while adhering to the inventive concept. Such variations are contemplated as being a part of the present invention.

What is claimed is:

1. A portable rotary cleaning device, comprising:

a housing, the housing having a pair of hose openings and at least two wheels for providing mobility to the housing, the housing has a housing top and a housing bottom, the housing top has a cap and wherein a drain is located at the housing bottom, the housing has a pair of cleaning tank hollows;

a water tank located within the housing, for containing a quantity of water, the water tank is in communication with the cap for filling the water tank prior to use;

a pair of cleaning solution tanks, for containing a quantity of cleaning solution, each of the cleaning solution tanks are selectively mountable within one of the cleaning solution tank hollows, and wherein said cleaning solution tanks are held within the cleaning solution tank hollows by attachment straps;

a brush handle having a brush handle head and a brush handle nozzle opposite from the brush handle head, the brush handle head having a motor, a shaft mechanically linked to the motor and selectively rotated thereby, and a brush socket attached to the shaft;

at least one brush, having a brush front, a brush back, and through channels extending between the brush front and brush back, the brush selectively attachable to the brush socket such that the brush back is oriented toward the brush handle;

a pair of brush handle hoses, attached to the handle and extending longitudinally with the handle, the brush handle hoses each having an open end at the brush handle head which is directed at the brush back, and each of the brush handle hoses extend along the handle to the housing, enter the housing through one of the hose openings;

a water pump in communication with the water tank and with one of the brush handle hoses;

a cleaning solution pump in communication with the cleaning solution tanks and the other of the brush handle hoses;

housing switches, located on the housing, including a housing water switch, a housing solution switch, and a rotation switch, for selectively enabling the water pump, the cleaning solution pump, and the motor, respectively; and handle buttons, located on the handle, including a handle water button, a handle solution button, and a handle rotation button, for selectively activating the water pump to pump water onto the brush back through one of the brush handle hoses, for selectively activating the cleaning solution pump to pump cleaning solution onto the brush back through the other of the brush handle hoses, and for selectively activating the motor to rotate the brush, respectively, when enabled by the housing water switch, the housing solution switch, and the housing rotation switch, respectively.

* * * * *